US006695152B1

(12) United States Patent
Fabrizio et al.

(10) Patent No.: US 6,695,152 B1
(45) Date of Patent: Feb. 24, 2004

(54) MERCHANDISING DISPLAY TRACK DEVICE

(75) Inventors: Dion Fabrizio, Powder Springs, GA (US); Ming Sun, Roswell, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 10/288,028

(22) Filed: Nov. 5, 2002

(51) Int. Cl.[7] ..... A47F 5/00
(52) U.S. Cl. ..... 211/59.2; 211/74; 211/175
(58) Field of Search ..... 211/59.2, 59.3, 211/175, 74, 153

(56) References Cited

U.S. PATENT DOCUMENTS 4,958,739 A * 9/1990 Spamer ..... 211/153
4,997,094 A * 3/1991 Spamer et al. ..... 211/59.2 X
5,024,336 A * 6/1991 Spamer ..... 211/59.2
5,454,513 A * 10/1995 Wilson
6,155,177 A * 12/2000 Backfisch
6,523,702 B1 * 2/2003 Primiano et al. ..... 211/175 X
6,615,995 B2 * 9/2003 Primiano et al. ..... 211/74

* cited by examiner

*Primary Examiner*—Robert W. Gibson, Jr.
(74) *Attorney, Agent, or Firm*—John L. James

(57) ABSTRACT

An elongate display track device has a plurality of track segments frangibly connected end-to-end to one another forming a continuous track for receiving a row of articles for sliding movement therealong. There are a front track segment defining an a-keyway, and a rear track segment defining a b-keyway. At least one first intermediate track segment has an a-key on one end and a b-key on the other end. The a-keys are mateable only with a-keyways and b-keys are mateable only with b-keyways. At least one second intermediate track segment has an b-keyway on one end a b-key on the other end. At least one third intermediate track segment has an b-keyway on one end an a-keyway on the other end. The track device is separated at the a-keys and a-keyways to shorten the track length and separated at the b-keys and b-keyways to lengthen the track to fit a shelf.

7 Claims, 1 Drawing Sheet

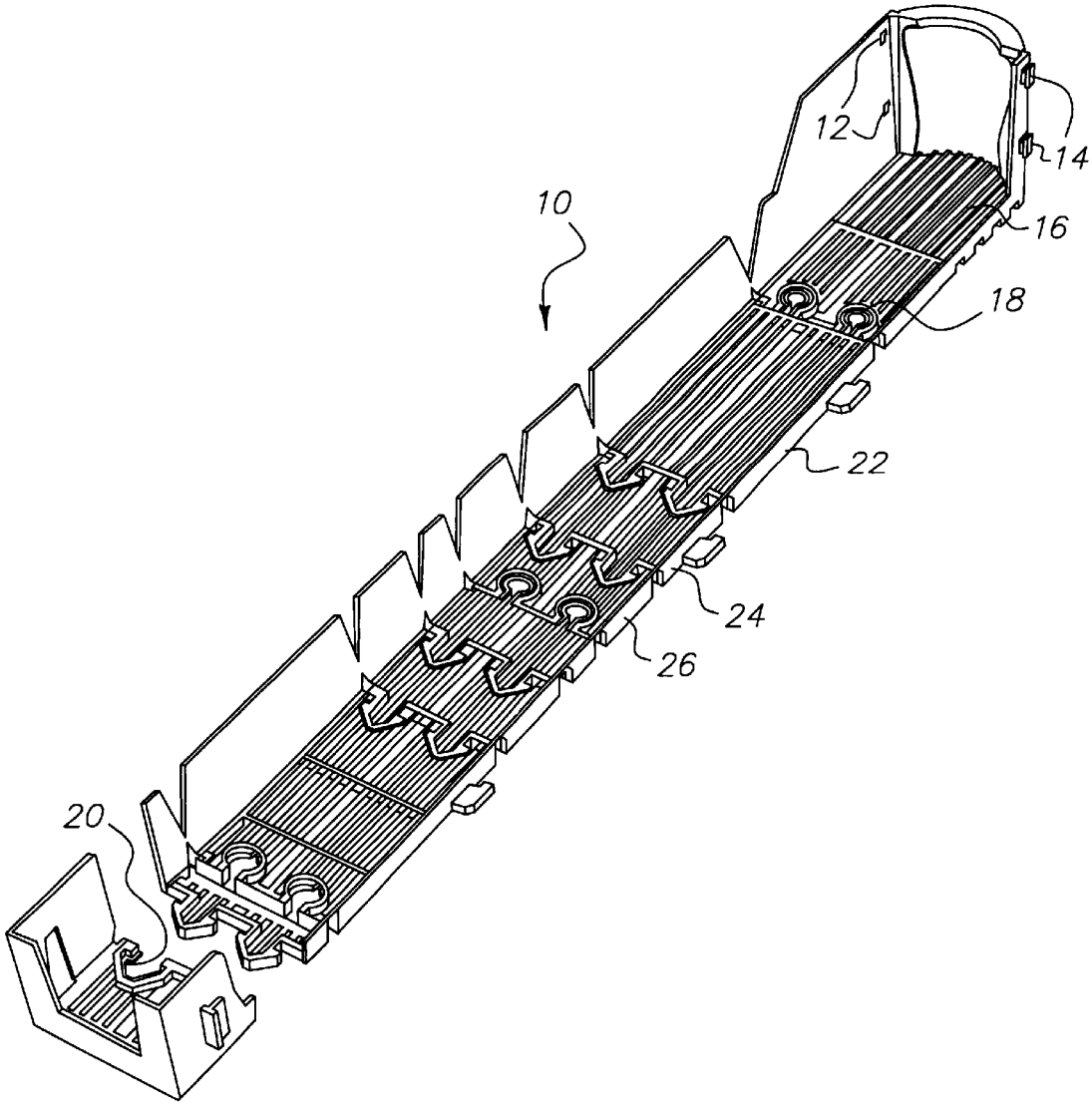
10
12
14
16
18
20
22
24
26

MERCHANDISING DISPLAY TRACK DEVICE

TECHNICAL FIELD OF THE INVENTION

This invention relates to a track device for a merchandising display shelf, and, more particularly, to an adjustable length track device for articles on the shelf, particularly bottles, to slide along.

BACKGROUND OF THE INVENTION

A display track unit is assembled from multiple track devices for merchandising articles such as bottled on canned drink products. The display track unit typically includes a plurality of elongated track devices detachably interconnected in side-by-side relationship. The number of track devices used to assemble the display track unit is determined such that the size of the unit is suitable for placement onto an existing display shelf in a retail environment to fill the width of the shelf.

Display tracks are useful for displaying bottles, especially beverage bottles, because a track stacks many bottles using a limited amount of shelf space which is always at a premium. Tracks foster a neat display and allow one bottle at a time to be removed without disheveling the other bottles. It is always desirable to have a track that maximizes product while minimizing shelf space required, reduces manufacturing cost, or reduces transportation and storage costs. It has been found that manufacturing costs are reduced when a single size track device is produced that has frangible portions that can be removed during installation to fit the front to rear length of a particular shelf.

It has also been discovered that customers sometimes find adjusting the track length time consuming because of uncertainty as to where to separate the track to add or remove a segment to alter the length of the track to fit the shelf. Accordingly, it will be appreciated that it would be highly desirable to have a track device whose length can be varied to fit a particular shelf without confusion, about where to separate the track.

SUMMARY OF THE INVENTION

The present invention is directed to overcoming one or more of the problems set forth above. Briefly summarized, according to the present invention, an elongate display track device has a plurality of track segments frangibly connected end-to-end to one another forming a continuous track for receiving a row of articles for sliding movement therealong. A front track segment defines an a-keyway and a rear track segment defining a b-keyway. At least one first intermediate track segment has an a-key on one end and a b-key on the other end, the a-keys are mateable only with a-keyways and b-keys are mateable only with b-keyways. At least one second intermediate track segment has a b-keyway on one end a b-key on the other end. At least one third intermediate track segment has an b-keyway on one end an a-keyway on the other end.

The different keys and keyways simplify lengthening or shortening the length of the track. A-keys and a-keyways are separated to remove segments to shorten the length while b-keys and b-keyways are separated to insert a track segment to lengthen the track. Because a-keys are visually different from b-keys, shortening and lengthening the track is easier.

These and other aspects, objects, features and advantages of the present invention will be more clearly understood and appreciated from a review of the following detailed description of the preferred embodiments and appended claims, and by reference to the accompanying drawings

BRIEF DESCRIPTION OF THE DRAWING

The drawing is a perspective view of a preferred embodiment of an adjustable track device with different keys and keyways according to the present invention.

DETAILED DESCRIPTION OF THE PREFERRED EMBODIMENTS

Referring to the drawing, a display track unit assembled from multiple track devices is designed to merchandise articles such as bottled or canned drink products. The display track unit includes a plurality of elongated track devices 10 detachably interconnected in side-by-side relationship. The number of track devices used to assemble the display track unit is determined such that the width of the unit is suitable for placement onto an existing display shelf in a retail environment. The interconnection of adjacent track devices is achieved by connecting means such as connector slots 12 cooperating with L-shaped horizontal connector elements 14. Details of the track devices is more fully set forth in application Ser. No. 09/999,317 filed Oct. 31, 2001, the disclosure of which is incorporated herein by reference.

A front track segment 16 defines an a-keyway 18 and a rear track segment 18 defines a b-keyway 20. The a-keyway 18 and b-keyway 20 are different so that they cannot be mistaken for one another. For example, the an a-keyway may be a semi-circle while a b-keyway may be a receptacle adapted to receive an arrowhead. These are mentioned for illustration purposes and not by way of limitation as there numerable examples of differing keyways.

At least one first intermediate track segment 22 has an a-key on one end and a b-key on the other end, the a-keys are mateable only with a-keyways and b-keys are mateable only with b-keyways. Each a-key may have a circular configuration of more than half a circle, and each a-keyway may have a mating circular configuration of more than half a circle. Or, each b-keyway may be a receptacle adapted to receive an arrowhead, and each b-key is an arrowhead. Of course, other configurations may be used as long as they are different enough to be easily distinguishable.

At least one second intermediate track segment 24 has an b-keyway on one end a b-key on the other end. At least one third intermediate track segment 26 has an b-keyway on one end an a-keyway on the other end. For greater physical integrity when interconnected, the keys and keyways preferably exist in pairs. The display track device is shortened by disassembling track segments at a union of a-keys and a-keyways. The display track device is lengthened by disassembling at a union of b-keys and b-keyways and inserting a second intermediate track section.

It can now be appreciated that a track device for a merchandising display shelf for a plurality of bottles to slide along has been presented. The track device is formed of track segments connected together in end-to-end relationship to fill the length of the shelf with tracks connected together in side-by-side relationship to fill the width of the shelf. The track segments include a front segment with one or more, preferably two, keyways, and a rear segment with an equal number of keys. A number of intermediate track segments have both keys and keyways, some have only keys while others have only keyways. As intermediate track segments are removed or added to fit a particular shelf, the keys and keyways at the break interlock to prevent separation of the track segments. To add a segment, the break occurs at the arrows or b-keys and b-keyways. Removing a track segment entails a break at the circles or a-keys and a-keyways. The arrows signify adding and circles signify removing track segments which simplifies altering track length. Because there are common or popular shelf lengths, track sections can be manufactured to separate to accommodate those lengths.

While the invention has been described with particular reference to the preferred embodiments, it will be understood by those skilled in the art that various changes may be made and equivalents may be substituted for elements of the preferred embodiments without departing from invention. For example, while the keys and keyways have been described as arrows or circular, other distinct interlocking shapes can be used with equal success. It is accordingly intended that the claims shall cover all such modifications and applications as do not depart from the true spirit and scope of the invention.

What is clamed is:

1. An elongate display track device having a plurality of track segments frangibly connected to one another end-to-end forming a continuous track for receiving a row of articles for sliding movement therealong, comprising:

a front track segment defining an a-keyway;

a rear track segment defining a b-keyway;

at least one first intermediate track segment having an a-key on one end and a b-key on the other end, said a-keys being mateable only with a-keyways and b-keys being mateable only with b-keyways;

at least one second intermediate track segment having an b-keyway on one end a b-key on the other end; and at least one third intermediate track segment having an b-keyway on one end an a-keyway on the other end.

2. An elongate display track device, as set forth in claim 1, wherein each said a-keyway has a circular configuration of more than half a circle.

3. An elongate display track device, as set forth in claim 2, wherein each said a-key has a circular configuration of more than half a circle.

4. An elongate display track device, as set forth in claim 3, wherein said display track device is shortened by disassembling at a union of a-keys and a-keyways.

5. An elongate display track device, as set forth in claim 1, wherein each said b-keyway is a receptacle adapted to receive an arrowhead.

6. An elongate display track device, as set forth in claim 5, wherein each said a-key is configured as an arrowhead.

7. An elongate display track device, as set forth in claim 6, wherein said display track device is lengthened by disassembling at a union of b-keys and b-keyways and inserting a second intermediate track section.

* * * * *